US007226323B2

(12) United States Patent
Noro et al.

(10) Patent No.: US 7,226,323 B2
(45) Date of Patent: Jun. 5, 2007

(54) CHAINED TERMINALS AND METHOD OF FORMING CHAINED TERMINALS

(75) Inventors: Yutaka Noro, Yokkaichi (JP); Yuuji Takahashi, Yokkaichi (JP); Hideyuki Tai, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/378,454

(22) Filed: Mar. 17, 2006

(65) Prior Publication Data

US 2006/0211312 A1 Sep. 21, 2006

(30) Foreign Application Priority Data

Mar. 17, 2005 (JP) ..... 2005-077790

(51) Int. Cl.
*H01R 9/24* (2006.01)

(52) U.S. Cl. ..... 439/885; 29/882; 29/874

(58) Field of Classification Search ..... 439/885, 439/884; 29/882, 874
See application file for complete search history.

(56) References Cited

U.S. PATENT DOCUMENTS 4,712,299 A * 12/1987 Loewen et al. ..... 29/882
5,067,916 A 11/1991 Denlinger et al.
5,340,337 A * 8/1994 Pentz ..... 439/843
5,609,505 A 3/1997 Endo et al.
6,024,612 A * 2/2000 Myer et al. ..... 439/852
6,139,377 A * 10/2000 Chen ..... 439/885
6,141,872 A 11/2000 Takanashi
6,264,511 B1 7/2001 Bu
6,729,916 B2 * 5/2004 Pan ..... 439/885
2003/0096533 A1 5/2003 Kojima et al.
2003/0100229 A1 5/2003 Ma et al.
2003/0119383 A1 6/2003 Sai et al.

* cited by examiner

*Primary Examiner*—Tho D. Ta
(74) *Attorney, Agent, or Firm*—Gerald E. Hespos; Anthony J. Casella

(57) ABSTRACT

Chained terminals have a carrier (1) with opposite first and second side edges and terminal fittings (2) coupled to the first side edge of the carrier (1). The carrier (1) is formed with feed holes (6, 7) in correspondence with the respective terminal fittings (2). A widened portion (8) is provided along the first side edge of the carrier (1) and the feed holes (6, 7) are deviated towards the second side edge along the width direction. Thus, strength can be increased by as much as the carrier (1) is widened, and production efficiency can be increased by increasing a conveying speed.

11 Claims, 4 Drawing Sheets

CHAINED TERMINALS AND METHOD OF FORMING CHAINED TERMINALS

BACKGROUND OF THE INVENTION

1. Field of the Invention

The invention relates to chained terminals.

2. Description of the Related Art

U.S. Pat. No. 5,609,505 discloses chained terminals obtained by punching an elongated band-shaped plate with a pressing machine. More particularly, the plate is punched to define a long narrow carrier and terminal fittings that cantilever from a side edge of the carrier. The terminal fittings then are formed into a specified shape by bending. Feed holes are formed through the carrier for conveyance. The feed holes are arranged at intervals corresponding to the arrangement intervals of the terminal fittings and are disposed along the center line of the carrier.

An intermittently rotatable sprocket is used to convey the carrier through the press working apparatus. The sprocket has a plurality feeding claws arranged on a conveyance path for the carrier. The feeding claws successively engage the feeding holes to create a pulling force that acts on the carrier in a feeding direction to convey the chained terminals. An increased conveying speed recently has become necessary to improve work efficiency. However, the carrier of conventional chained terminals lacks strength, and can deform at high conveying speeds. A deformed carrier may position the terminal fittings imprecisely in the press working apparatus and may lead to defects. Accordingly, there has been a demand for a carrier that will not deform at higher conveying speeds.

A thicker base material for the chained terminals would be stronger. However, the thicker material costs more and leads to larger terminal fittings. A wider carrier also would be stronger. However, a wider carrier could require changes to the distances between the feed holes and the respective parts of the terminal fittings. Thus, a wider carrier could affect existing specifications and could be difficult to adopt. Further, a wider carrier could increase the amount of scrap that remains after the blank has been cut.

The invention was developed in view of the above problems, and an object thereof is to provide chained terminals with a stronger carrier.

SUMMARY OF THE INVENTION

The invention relates to chained terminals that comprise an elongated carrier with opposite first and second side edges. Terminal fittings extend from the first side edge of the carrier and holes penetrate the carrier. The carrier further includes at least one widened portion at the first side edge thereof. The holes are deviated towards the second side edge with respect to a center line of the carrier.

The widened portion widens the carrier and hence increases the strength of the carrier. Further, the widened portion is at the side coupled to the terminal fittings. Thus, the width of the entire array of chained terminals does not exceed the width of the prior art chained terminals. Conversely, the width and cost of the chained terminals would increase if the widened portion was at the side opposite to the terminal fittings.

The carrier preferably is substantially band shaped.

The holes preferably are used to convey the chained terminals.

Barrel pieces preferably are formed at an end of each terminal fitting near the carrier and can be crimped into connection with a wire. The barrel pieces preferably are parallel with an extending direction of the carrier.

At least one die-punched region preferably is defined between adjacent coupling pieces that couple the terminal fittings to the carrier. The die-punched region also preferably is defined by the opposed barrel pieces of adjacent terminal fittings and the carrier.

A widened portion or reinforcing tab preferably is substantially in a middle part of each die-punched region with respect to the longitudinal direction of the carrier. Thus, wider openings are formed in the die-punched region at the opposite ends of the reinforcing tab. The wider openings are wider than a part of the die-punched region corresponding to the widened portion.

The widened portion is at the side of the carrier towards the terminal fittings. Thus, smaller spaces are defined between the carrier and the terminal fittings and require a smaller punching die. The smaller punching die conceivably could have insufficient strength if the widened portion extended over the entire length of the carrier. However, the widened portion is only in the middle of each die-punched region, and parts of the die-punched region at the opposite ends of the widened portion remain wide. Thus, parts of the punching die corresponding to the wider opening portions can be large and strong.

Opposite longitudinal edges of each widened portion or reinforcing tab preferably are tapered so that the widened portion is longer adjacent the carrier. Accordingly, the strength at each widened portion is increased.

The widened portion or reinforcing tab preferably has substantially the same length as the respective feed hole.

These and other features and advantages of the invention will become more apparent upon reading the following detailed description of preferred embodiments and accompanying drawings. Even though embodiments are described separately, single features may be combined.

DETAILED DESCRIPTION OF THE PREFERRED EMBODIMENTS

Figure 1:
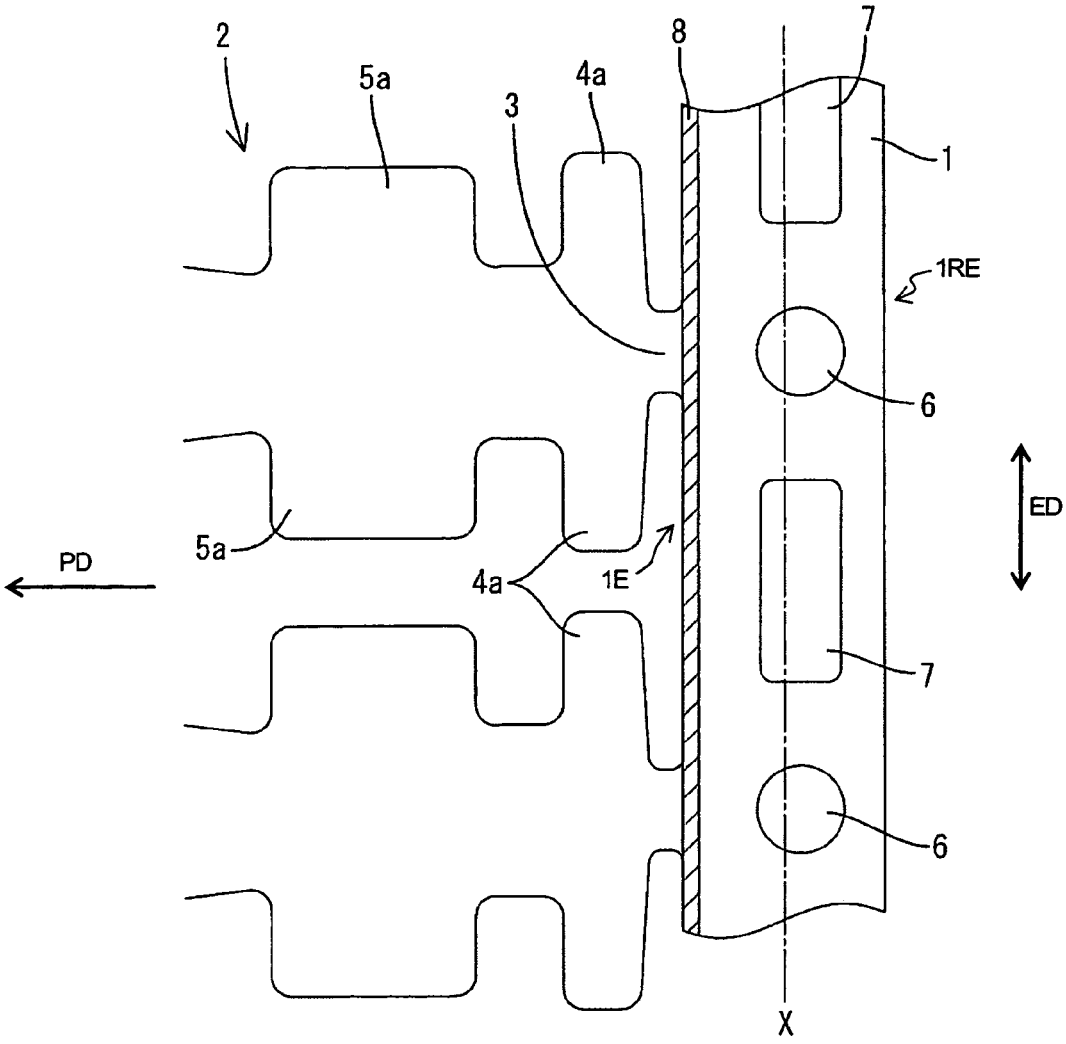
FIG. 1 is a plan view showing an essential portion of chained terminals of a first embodiment in a development after being punched out.

Chained terminals according to a first embodiment of the invention are described with reference to FIGS. 1 and 2. The chained terminals are punched from an elongated metallic plate to define a blank of a specified shape, as shown in FIG. 1. The chained terminals include a carrier 1 in the form of an elongated band that extends in an extending direction ED. The carrier 1 has opposite first and second side edges 1E and 1RE. Female terminal fittings 2 cantilever or project in a projecting direction PD from the first side edge 1E of the carrier 1. The projecting direction PD of each terminal fitting 2 is substantially orthogonal to the extending direction ED of the carrier 1. The terminal fittings 2 are spaced apart at substantially even intervals along the extending direction ED. Coupling pieces 3 extend unitarily between the carrier 1 and the respective terminal fittings 2. The coupling pieces 3 are located substantially on the widthwise center axes of the corresponding terminal fittings 2, as shown in FIG. 1.

Two barrel pieces 4*a* of an insulation barrel 4 are formed at a part of each terminal fitting 2 substantially adjacent to the coupling piece 3. The barrel pieces 4*a* are configured to be crimped into connection with an insulation coating of a wire. Two barrel pieces 5*a* of a wire barrel 5 are at a position slightly distanced from the insulation barrel 4 along the projecting direction PD. The barrel pieces 5*a* are configured to be crimped into connection with a core of a wire. The barrel pieces 5*a* have a longitudinal dimension along the projecting direction PD larger than a longitudinal dimension of the barrel pieces 4*a* along the projecting direction PD. As shown in FIG. 2, a connecting portion 6 projects beyond the wire barrel 5 for electrical connection with a mating terminal fitting.

Substantially round first feed holes 6 penetrate the carrier 1 on extensions of the widthwise center axes of the corresponding terminal fittings 2 along the projecting direction PD. The first feed holes 6 are used to convey the terminal fittings 2 between steps of the press-working process (e.g. a punching step, a cutting/bending step, and/or a bending step). Substantially rectangular second feed holes 7 penetrate the carrier 1 at locations substantially symmetrically between the first feed holes 6. The second feed holes are used to convey the terminal fittings 2 to an automatic machine for crimping the terminal fittings 2 into connection with wires. The first and second feed holes 6, 7 are located on an axis line along the longitudinal extension direction ED of the carrier 1.

Figure 2:
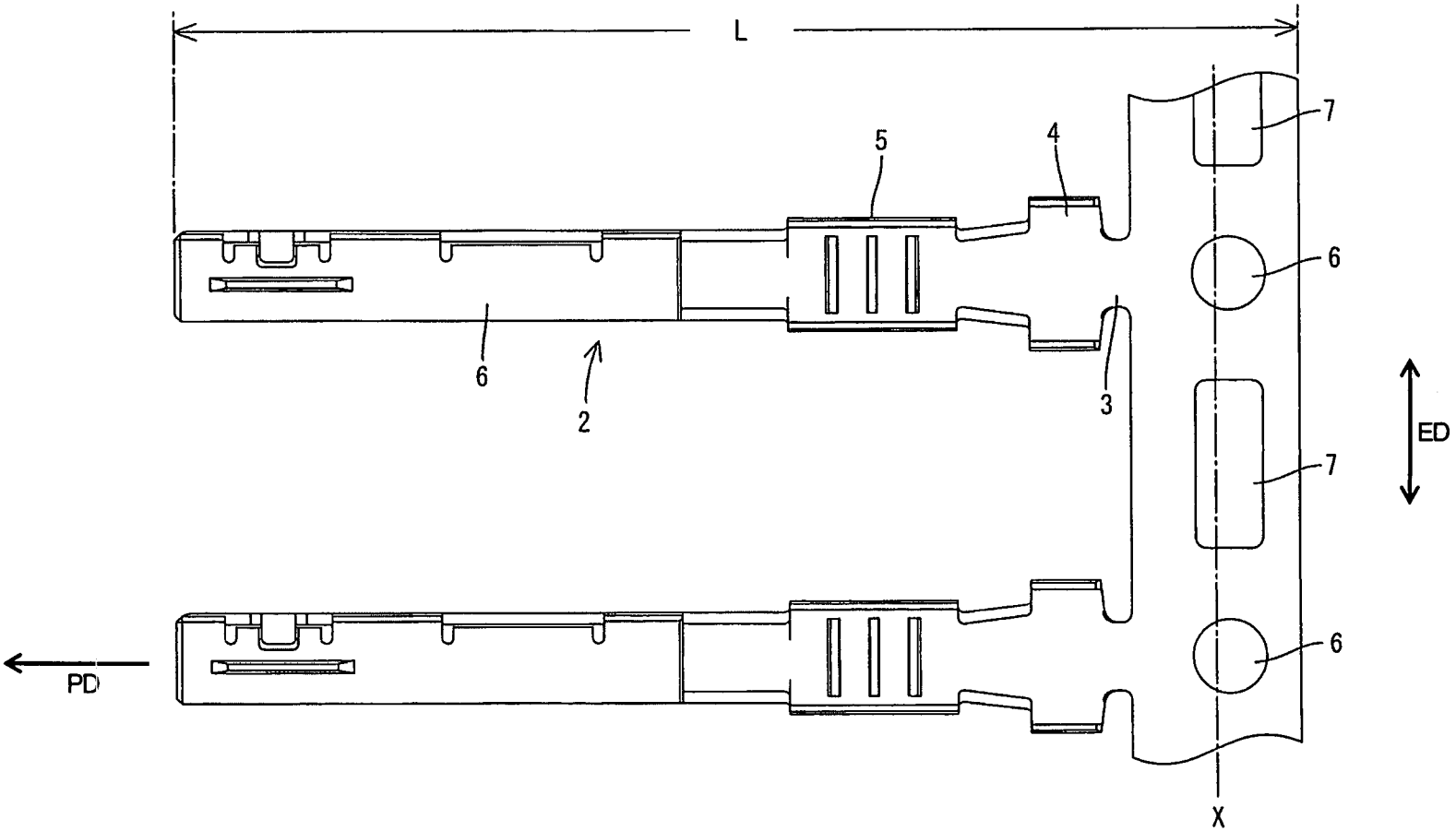
FIG. 2 is a plan view of the chained terminals showing a state where finished terminal fittings are coupled.

A distance L in FIG. 2 extends along the projecting direction PD between the leading ends of the respective terminal fittings 2 and the second side edge 1RE of the carrier 1 and is substantially the same as in the prior art. The feed holes are on the widthwise center axis of the carrier 1 in the conventional chained terminals described above. However, the feed holes 6, 7 are offset laterally from the widthwise center axis X in FIGS. 1 and 2 in a direction substantially opposite to the projecting direction PD (to right in FIG. 2). The axis X is defined as being equidistant from the first and second side edges 1E, 1RE of the carrier 1. Thus, the carrier 1 has a widened portion 8 (hatched in FIG. 1) over substantially the entire length at a side to which the respective terminal fittings 2 are coupled.

The widening at the side of the carrier 1 coupled to the terminal fittings 2 increases the strength of the carrier 1 as compared to the conventional carriers. Therefore, the carrier 1 is less likely to deform at higher conveying speeds. Conversely, the existing strength of the carrier 1 can be maintained while using a thinner and less expensive material as compared to currently produced chained terminals. Further, the widened portion 8 is at the side of the carrier 1 connected with the terminal fittings 2. Thus, unlike the case where the carrier 1 is widened at a side opposite the terminal fittings 2, the dimension L is not increased, and the metal is used more efficiently. Furthermore, the widened portion is formed over substantially the entire length of the carrier 1, and hence the strength of the carrier 1 is increased substantially uniformly along the extension direction ED.

A second embodiment of the invention is described with reference to FIG. 3, which shows a chained terminal blank that has been punched out, but not yet formed from the planar state. Die-punched regions 9 are defined between the barrel pieces 4*a* of adjacent terminal fittings 2 and the carrier 1. The die-punched regions 9 would be narrow over their entire lengths if a widened portion 8*a* was formed over the entire length of the carrier 1, as in the first embodiment. Thus, narrow and potentially weak press dies would be required for punching out the regions 9.

The widening of the second embodiment is achieved by reinforcing tabs 8*a* only in a longitudinal intermediate part of each die-punched region 9 and substantially in the same length range as the second feed hole 7. Thus, an opening of a relatively large width exists between remaining parts of the carrier 1 and the narrower barrel pieces 4*a*, as shown in FIG. 3.

The reinforcing tabs 8*a* of the second embodiment are only in the part of the die-punched region 9 aligned with the second feed holes 7. Thus, a larger stronger press die can be used to form the die-punched region 9, and the carrier 1 is stronger near the second feed holes 7.

Figure 3:
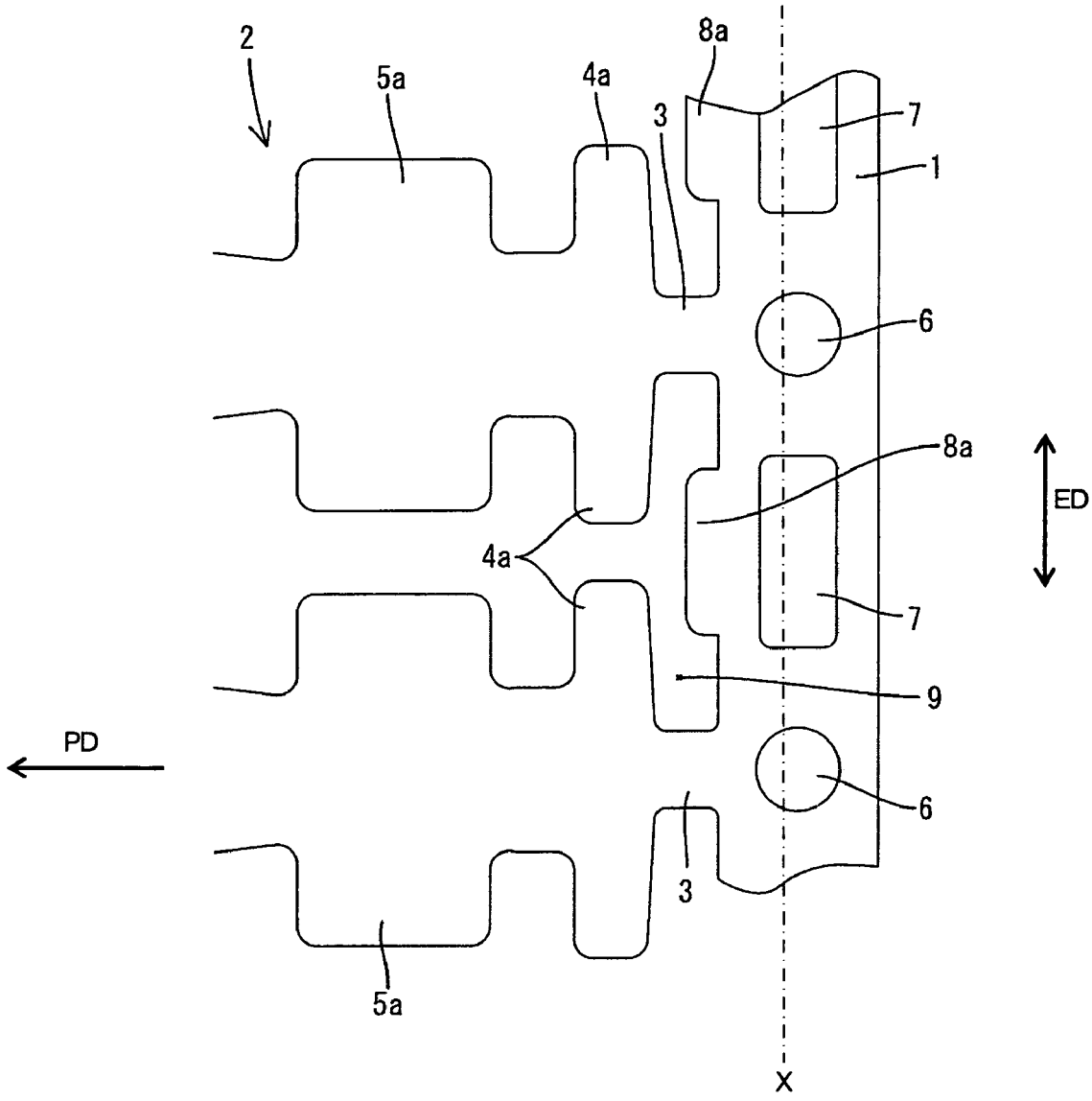
FIG. 3 is a plan view showing a second embodiment.

The other construction is similar to the first embodiment, and the first and second feed holes 6, 7 are deviated to the right in FIG. 3 from the widthwise center axis X of the carrier 1, including the widened portions 8*a*.

Figure 4:
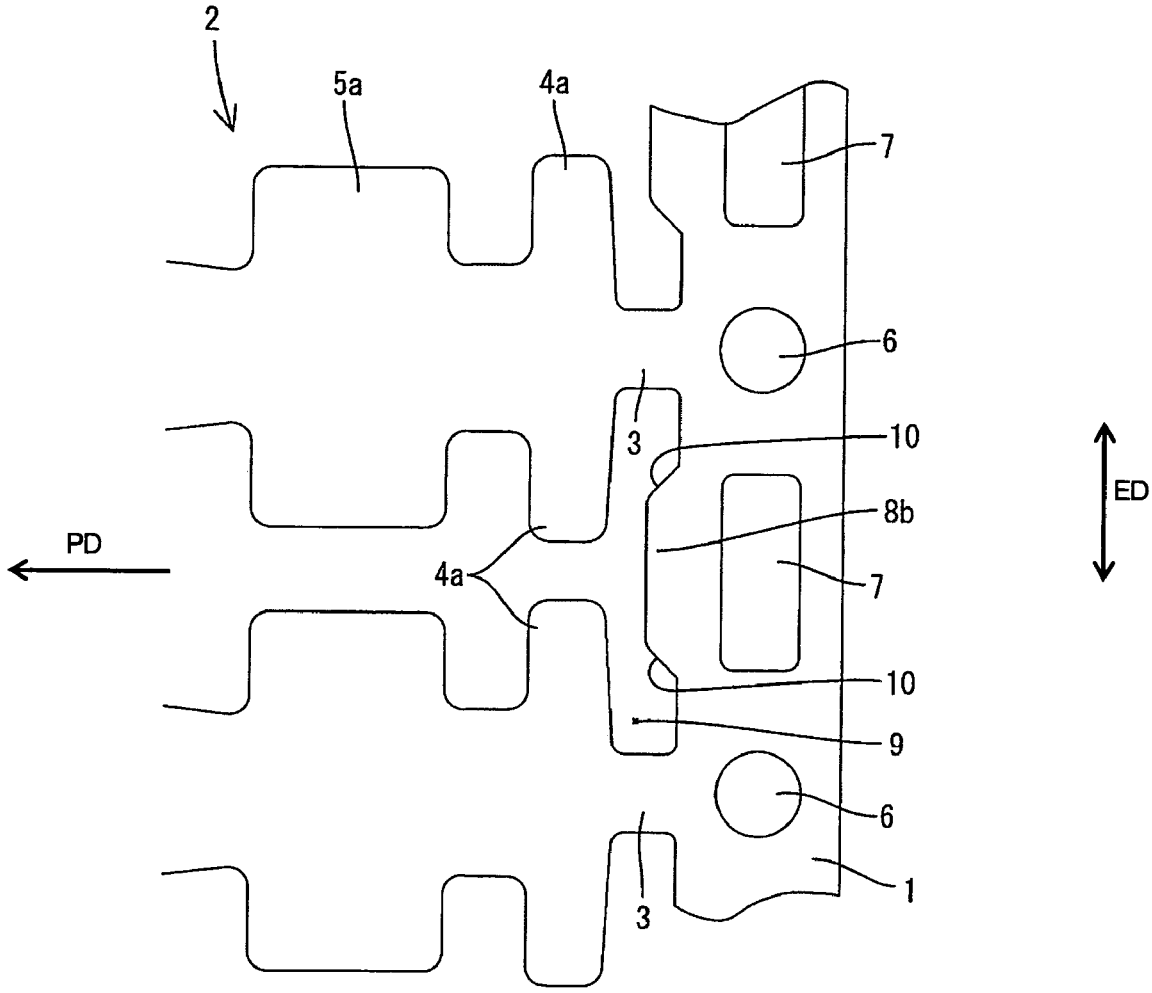
FIG. 4 is a plan view showing a third embodiment.

FIG. 4 shows a third embodiment that is similar to the second embodiment. However, the third embodiment has sloped edges 10 at opposite longitudinal ends of the reinforcing tabs 8*b*. Specifically, the opposite longitudinal ends 10 of each reinforcing tabs 8*b* are sloped to taper the tab 8*b* from the base side towards the leading end. Accordingly, the reinforcing tabs 8*b* including the sloped edges 10 are substantially trapezoidal in plan view, and the sloped edges 10 define an obtuse angle to the adjacent edges 1E, 1RE of the carrier 1. The third embodiment has an advantage of increasing the strength of the reinforcing tabs 8*b* in addition to the functions and effects of the second embodiment.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

The chained terminals are female terminal fittings in the foregoing embodiments. However, the invention may be applied to male terminal fittings.

The carrier at one side of the terminal fittings in the foregoing embodiments. However, carriers may be provided at the opposite sides of the terminal fittings. Further, the terminal fittings need not be coupled to extend substantially orthogonally to the longitudinal direction of the carrier, and may extend obliquely.

Two kinds of feed holes are not always necessary, and all feed holes may be substantially identical.

The widened portions are at least at the side of the carrier where the terminal fittings are connected, but the invention is not hindered by widened portions at the opposite side.

The terminal fittings may project from both sides of the carrier.

What is claimed is:

1. Chained terminals, comprising: a substantially band-shaped carrier with opposite first and second side edges, coupling pieces extending from the first side edge of the carrier, terminal fittings extending from the respective coupling pieces, barrel pieces for connection with a wire bulging out substantially parallel to an extending direction of the carrier substantially at an end of each terminal fitting in proximity to the carrier, first holes at least partly penetrating the carrier at positions aligned with the coupling pieces, the carrier being substantially free of holes between the first holes and the coupling pieces, second holes penetrating the carrier at locations symmetrically between the first holes, the first and second holes being spaced substantially equal first distances from the first side edge of the carrier and being spaced substantially equal second distances from the second side edge of the carrier the first distance being greater than the second distance so that the carrier is stronger between the first side edge and the first and second holes for accommodating forces exerted during formation of the terminal fitting while using the first and second holes to convey the chained terminals at high speed.

2. The chained terminals of claim 1, wherein the holes are used to convey the chained terminals.

3. The chained terminals of claim 1, wherein each of the widened portions has tapered edges at opposite longitudinal ends of the respective widened portion so that each of the widened portions is longer adjacent the carrier.

4. The chained terminals of claim 1, wherein each of the widened portions has a length along the extending direction substantially equal to a length of the respective feed hole.

5. The chained terminals of claim 1, wherein coupling pieces couple the respective terminal fittings to the carrier, at least one die-punched region being defined between coupling pieces of adjacent terminal fittings on the carrier.

6. The chained terminals of claim 5, wherein the die-punched region is defined by the opposed barrel pieces of the adjacent terminal fittings, the coupling pieces coupling the terminal fittings to the carrier, and the carrier.

7. The chained terminals of claim 5, wherein the widened portion is formed substantially in a middle part of each die-punched region with respect to the extending direction of the carrier, and wider openings are formed in the die-punched region at the opposite ends of the widened portion, the wider openings being wider than a part of the die-punched region corresponding to the widened portion.

8. Chained terminals, comprising: an elongated carrier, terminal fittings extending from a first side edge of the carrier, reinforcing tabs being formed at the first side edge of the carrier at locations between the terminal fittings, first feed holes being formed through the carrier at locations aligned with the terminal fittings, second feed holes being formed through the carrier at locations aligned with the reinforcing tabs, reinforcing tabs having lengths measured parallel to the first side edge that are substantially equal to lengths of the second feed holes measured parallel to the first side edge, whereby the reinforcing tabs strengthen the carrier at locations aligned with the second feed holes.

9. The chained terminals of claim 8, wherein the reinforcing tabs are substantially trapezoidal and have end edges that taper towards one another at locations farther from the second feed holes.

10. The chained terminals of claim 8, wherein the carrier has a second side edge opposite the first side edge, the second feed holes being closer to the second side edge than to edges of the reinforcing tabs opposite the second side edge.

11. The chained terminals of claim 10, wherein the first and second feed holes are substantially equally spaced from the second side edge.

* * * * *